United States Patent [19]

Johannes

[11] 4,278,480

[45] Jul. 14, 1981

[54] SLURRY TYPE EXPLOSIVE

[76] Inventor: Gerald E. Johannes, 565 Frank Ave., S.E., Huron, S. Dak. 57350

[21] Appl. No.: 63,688

[22] Filed: Aug. 6, 1979

[51] Int. Cl.[3] ..... C06B 45/00

[52] U.S. Cl. ..... 149/2; 149/46; 149/87; 149/92; 149/93; 149/105; 149/108.2

[58] Field of Search ..... 149/2, 46, 92, 93, 105, 149/87, 108.2

[56] References Cited

U.S. PATENT DOCUMENTS

| | | | |
|---|---|---|---|
| 3,462,952 | 8/1969 | D'Alelio | 149/87 X |
| 3,650,855 | 3/1972 | Mackenzie | 149/87 X |

*Primary Examiner*—Stephen J. Lechert, Jr.

*Attorney, Agent, or Firm*—LeBlanc, Nolan, Shur & Nies

[57] ABSTRACT

A permanently tacky slurry type explosive comprises polyisobutylene containing a balanced fuel explosive phase in the form of an explosive material in particulate condition (ammonium nitrate, PETN, RDX and the like) and a minor amount of a carbon fuel (oil or carbon particles).

9 Claims, No Drawings

SLURRY TYPE EXPLOSIVE

This invention relates to slurry type explosives and particularly to such which employ polyisobutylene as a carrier and a carbonaceous material such as a hydrocarbon oil or finely divided carbon as a fuel for the explosive.

The invention is concerned with an explosive product wherein a fuel balanced explosive is uniformly distributed in a polyisobutylene carrier. Preferably the fuel balanced explosive is a mixture of a particulate explosive material and a granular or powdered carbon or hydrocarbon oil fuel. The fuel may for example be ordinary motor oil, diesel oil such as normally used as fuel, fuel oil, fine carbon such as lamp black and ground charcoal, or any equivalent. The explosive may advantageously be ammonium nitrate. However, this may be admixed with or replaced by equivalent amounts of other conventional explosives such as PETN (pentaerythritol tetranitrate) or RDX (cyclotrimethylenetrinitramine) or mixtures of PETN and RDX, pentolite, and aluminum powder.

Elastomeric carrier explosives embodying PETN and RDX have been proposed and used and examples of such are disclosed in U.S. Letters Patents to Fassnacht et al U.S. Pat. No. 2,992,087; Breza et al U.S. Pat. No. 2,999,743 who discloses isobutylene as a carrier for PETN or RDX; Forrest et al U.S. Pat. No. 2,311,513 and Evans U.S. Pat. No. 3,407,731.

The present invention has for its major object the provision of a novel explosive product originally in the form of a slurry made by mixing pourable polyisobutylene, a particulate explosive selected for the group consisting of ammonium nitrate, PETN, RDX, aluminum powder, TNT and the like, together with a predetermined amount of oxidizable material as fuel for combination with the nitrate in the explosive, this fuel being in the form of a hydrocarbon oil or fine carbon particles such as ground charcoal.

It is a further related object of the invention to provide such an explosive product wherein the ratio of explosive material fuel oil is in the range of about 15–25 to 1, and the ratio of polyisobutylene to fuel oil is in the range of about 1–10 to 1, the parts being by weight.

Further objects will appear as the description proceeds in connection with the following examples and the appended claims:

EXAMPLE I 96 parts by weight of particulate ammonium nitrate was mixed with 4 parts by weight of 10w motor oil to provide a fuel balanced explosive phase, until the oil apparently penetrated the particles. 25 parts of polyisobutylene in fluent condition was mixed with 75 parts by weight of the fuel balanced explosive phase.

The resultant product was a tacky water impermeable slurry which was promptly applied to a rock surface and detonated by a standard cap fuse with good results.

EXAMPLE II

Polyisobutylene was mixed with motor oil, about 10w grade. The polyisobutylene was a semi-solid but fluent material and its viscosity was reduced by heating so that it could be readily poured into the oil. Ammonium nitrate in finely ground form was added into the polyisobutylene-oil mixture. A preferred overall mixture contained the foregoing materials in proportions of 80 parts by weight of ammonium nitrate, 15 parts by weight of polyisobutylene and 5 parts by weight of oil.

In this aspect of the invention, as in Example I, the ratio of ammonium nitrate to fuel oil by weight is about between fifteen to twenty-five parts ammonium nitrate to one part oil, and the ratio of polyisobutylene to fuel oil by weight is about one to ten parts polyisobutylene to one part of oil.

The resultant product was of relatively heavy doughlike consistency. It was tacky and directly inserted into cartridge paper, and the product detonated, with good results. The material was water proof and extrudable and since it is tacky it may be attached directly to almost any surface.

EXAMPLE III

The polyisobutylene, oil and ammonium nitrate were admixed as in Example II, and then ammonium perclorate was added as a sensitizer, the ammonium perchlorate being added in amounts of 25–40% of the ammonium nitrate present. When ammonium perchlorate was so introduced it was found that up to double the amount of motor oil or other carbon fuel could be incorporated into the mixture thus adding more fuel for the nitrate and improving the explosion.

This compound has been found to detonate at 14000 ft/sec, and by adding five percent by weight of hexamethyoltetramine the detonation was increased to 17000 ft/sec in an extension of the example.

EXAMPLE IV

The composition of Example III had about five percent by weight carbon in the form of finely ground charcoal added into the ammonium perchlorate. This increased the fuel available to the nitrate, and otherwise the product had the characteristics of the earlier examples.

EXAMPLE V

A mixture containing 25% polyisobutylene, 20% ammonium perchloroate, 5% carbon (ground charcoal) and 50% ammonium nitrate resulted in a viscous slurry composition which was heated to flowable condition and placed in a bore hole, allowed to stand for about a week and then detonated. The explosion was extremely successful and localized at the site.

EXAMPLE VI

A mixture of 70% ammonium nitrate and fuel oil (about 14 parts nitrate to 1 oil), 20% polyisobutylene and 10% aluminum poweder was formed. The aluminum may range in size from a coarse grade in the range of 20–400 microns to a fine grade in the range of 5100–7300 microns. The nitrate-oil-polyisobutylene mass was heated and the aluminum added, and the resultant product allowed to cool. A satisfactory explosive was produced.

Small amounts of other explosives such as pentolite, trinitrotoluene or high strength dynamite may be added as boosters to ensure detonation.

EXAMPLE VII

20% polyisobutylene was admixed with 70% water wet PETN and 10% 10w motor oil. The polyisobutylene was heated slightly and the PETN slowly added while the mixture was agitated. Then the oil was added.

The resultant viscous mass was allowed to cool to ambient temperature, and in the cooled condition it was extruded into desired shapes. This material was detonated with a standard blasting cap.

Other high explosives may be added instead of the PETN, such as trinitrotoluene which may wholly or partly replace the PETN, with predictable resultant products.

EXAMPLE VIII

70% pentolite (equal parts of powdered TNT and PETN) was admixed with 20% polyisobutylene and 10% aluminum powder. The resultant product was a thick slurry. It resisted moisture and could be detonated by a standard blasting cap. It retained tacky characteristics and when exposed to moisture such as humid air it became even more tacky. The shelf life is at least five years.

In all of the foregoing examples the explosive results may be varied by substitution of different known explosive materials in granular or finely divided form, depending upon the problem and the results desired.

The novel product in each case is permanently tacky slurry which is immediately available to be adhesively applied to a site, and as it ages it becomes more self-supporting but retains its surface tackiness so as to be attached to a surface directly or wrapped in cartridge paper for some uses. The product is absolutely insensitive to rain or other water and may be placed underwater and remain active for long periods. While it is detonated by a standard blasting cap, it is quite resistant to the impact of normal handling. It remains active even under subzero weather conditions.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A slurry type explosive comprising polyisobutylene containing a dispersed mixture of one or more particulate explosive materials selected from the group consisting of ammonium nitrate, pentaerythilol tetranitrate, cyclotrimethylenetrinitramine, pentolite, aluminum powder and powdered trinitrotolyene admixed with a minor amount of a oxidizable fuel selected from the group consisting of hydrocarbon oils and carbon in particle form.

2. The slurry type explosive defined in claim 1, wherein the explosive material is ammonium nitrate and the fuel is a hydrocarbon oil such as fuel oil or motor oil.

3. The slurry type explosive defined in claim 2, wherein the ratio of ammonium nitrate to oil is in the range of about 25-1 to one, and the ratio of polyisobutylene to oil is in the range of 10-1 to one, all in parts by weight.

4. The slurry type explosive defined in claim 1, wherein the explosive is ammonium nitrate containing ammonium perchlorate in amounts of about 25–40% by weight of the ammonium nitrate present.

5. The slurry type explosive defined in claim 1, wherein the fuel is one or more materials selected from the group consisting of ground charcoal, lampblack and any high carbon natural material such as pulverized coal.

6. A tacky slurry type explosive comprising a balanced fuel explosive phase consisting of about 96 parts by weight of ammonium nitrate to four parts by weight of hydrocarbon oil admixed with polyisobutylene in the proportions of about 25 parts of the polyisobutylene to about 75 parts by weight of the explosive phase.

7. A tacky slurry type explosive comprising about 25% polyisobutylene, about 50% ammonium nitrate, about 20% ammonium perchlorate and about 15% carbon particles.

8. A tacky slurry type explosive comprising about 70 parts of a mixture of ammonium nitrate and hydrocarbon oil (14 parts ammonium nitrate to 1 part oil), about 20 parts polyisobutylene and about 10% aluminum powder, in parts by weight.

9. A tacky slurry type explosive comprising about 20% polyisobutylene, 70% of a particulate explosive selected from the group consiting of pentaerythitol tetranitrate, cyclotrimethylenetrinitramine and pentolite, and about 10% of an oxidizable material selected from the group consisting of hydrocarbon oil, fine carbon particles and aluminum powder.

* * * * *